United States Patent [19]

Blore et al.

[11] 4,133,191

[45] Jan. 9, 1979

[54] KNITTED FABRIC HAVING OPEN AREAS

[75] Inventors: James H. Blore; Bobby L. Balcombe, both of Greenville, S.C.

[73] Assignee: Phillips Fibers Corporation, Greenville, S.C.

[21] Appl. No.: 675,420

[22] Filed: Apr. 9, 1976

[51] Int. Cl.[2] ..... D04B 11/04

[52] U.S. Cl. ..... 66/197; 28/163; 156/148

[58] Field of Search ..... 428/253, 296, 257; 156/148, 306; 28/73, 163; 66/172, 197

[56] References Cited

U.S. PATENT DOCUMENTS

| | | | |
|---|---|---|---|
| 682,904 | 9/1901 | Blaetz | 66/172 |
| 1,646,199 | 10/1927 | Hinchliff | 66/172 |
| 1,721,390 | 7/1929 | Hadfield | 66/172 |
| 2,811,029 | 11/1957 | Conner | 66/172 |

*Primary Examiner*—James J. Bell

[57] ABSTRACT

A fabric having open areas is knitted from a plurality of body yarns interspersed at intervals with locking yarns having a lower melting temperature by casting off selected loops in selected body yarns, causing the cast-off loops to unravel toward but not past the respective locking yarn, and heating the fabric to cause the locking yarns to fuse to the touching body yarns, thereby preventing the cast-off loops from unraveling past the respective locking yarn.

23 Claims, 3 Drawing Figures

KNITTED FABRIC HAVING OPEN AREAS

The invention relates to knitted fabrics having open areas and to methods of producing such fabrics.

It is frequently desirable for reasons of comfort as well as for aesthetic reasons that a fabric have open areas therein. This is particularly true for drape, curtain and casement fabrics. It is also desirable to have fabrics which possess various characteristics of double knit fabrics without the relatively high weights normally found in double knit fabrics.

Accordingly, it is an object of the invention to provide a new and improved fabric. Another object of the invention is to provide a fabric having open areas. A further object of the invention is to reduce the weight of a double knit fabric. Another object of the invention is to provide a new fabric which is particularly suited for use as curtain, drape or casement fabric. Other objects, aspects and advantages of the invention will be apparent from a study of the specification, the drawings and the appended claims to the invention.

In accordance with the present invention these objects can be achieved by forming a fabric by knitting at least one body course employing at least one first yarn; then knitting, in immediate succession to said at least one body course, at least one first locking course employing at least one second yarn, said second yarn being formed of a thermoplastic material having a lower melting point than said first yarn; and then in immediate succession to said at least one first locking course, knitting a first plurality of consecutive body courses employing a plurality of first yarns while causing, in each of a plurality of areas in said first plurality of consecutive body courses, at least one stitch to be cast off; stressing the thus knitted fabric to cause said cast-off stitches to unravel to a point near to but not past said at least one first locking course employing at least one second yarn; heating the thus stressed fabric to a temperature above the melting point of said at least one second yarn and below the melting point of said first yarns to cause said at least one second yarn to fuse to the touching first yarns; and cooling the thus heated fabric to a temperature below the melting point of said at least one second yarn to thereby prevent the cast-off stitches from unraveling through said at least one first locking course employing at least one second yarn.

In the drawings

Figure 1:
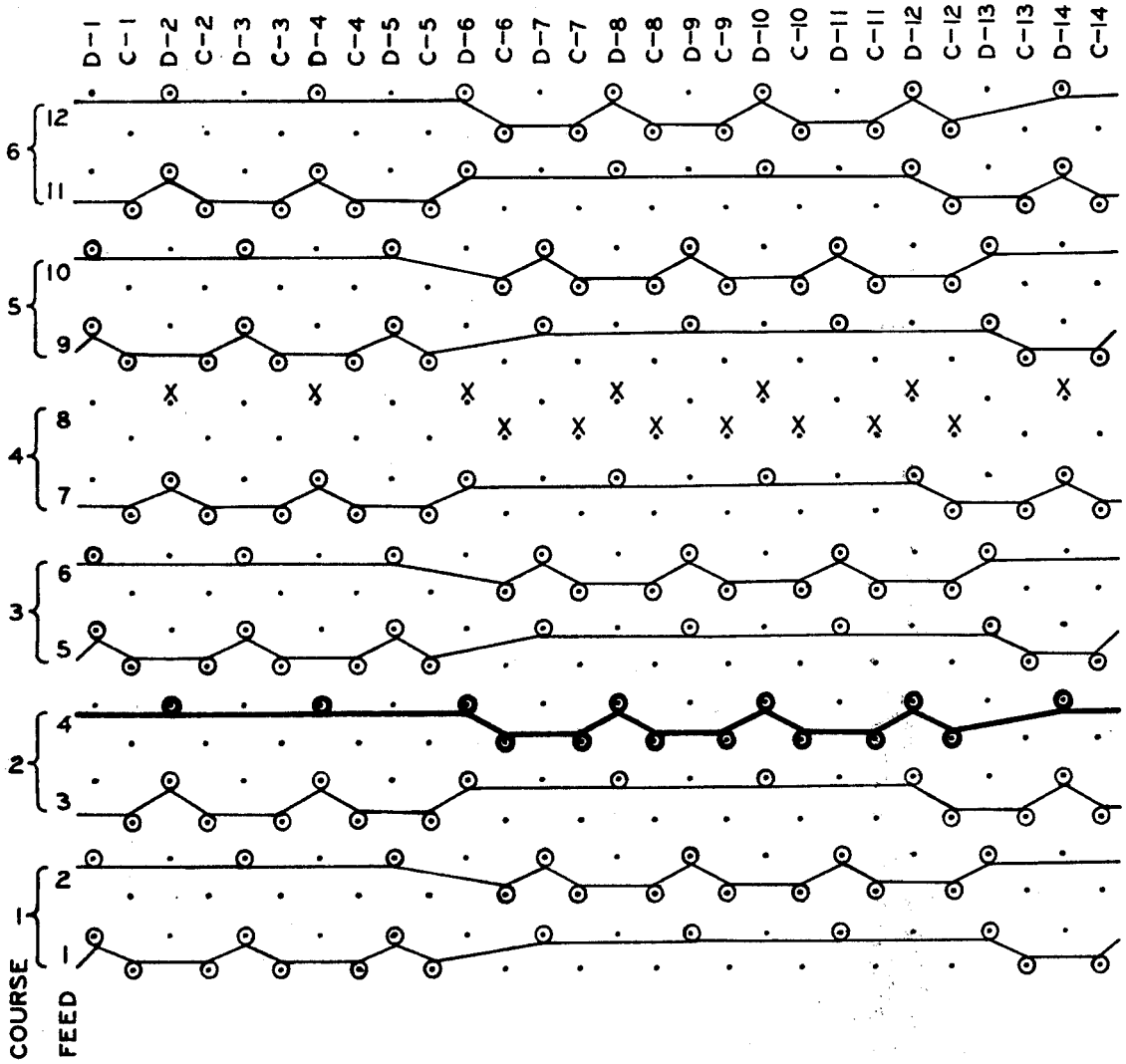
FIG. 1 is a pattern diagram of the stitches in the repeat pattern of one fabric in accordance with the invention.

Referring now to the drawings in detail, the illustrated fabric has a repeat pattern of 12 feeds and 28 wales. This double knit fabric has a first set of alternating wales C1, C2, C3 . . . C13 and C14 formed by the knitting action of the cylinder needles and a second set of alternating wales D1, D2, D3 . . . D13 and D14 formed by the knitting action of the dial needles. The cylinder wales C1, C2 . . . C14, which form the face of the fabric, alternate with the dial wales D1, D2 . . . D14, which form the reverse side of the fabric. Thus, each cylinder wale in the interior of the fabric is positioned between two dial wales. In the finished fabric the set of cylinder wales are in a plane parallel to the set of dial wales, and the fabric contracts laterally so that the set of cylinder wales contact each other to form the face of the fabric and the set of dial wales contact each other to form the reverse side of the fabric.

Each course comprises a first, or odd numbered feed, yarn and a second, or even numbered feed, yarn. In the odd numbered courses, both yarns have knit stitches in the odd numbered dial wales D1, D3 . . . D13 and welt stitches in the even numbered dial wales D2, D4 . . . D14. In the even numbered courses, both yarns (except for feed 8) have welt stitches in the odd numbered dial wales D1, D3 . . . D13 and knit stitches in the even numbered dial wales D2, D4 . . . D14. This pattern of dial stitches produces a pique back. On feed 8, there is no yarn fed to the needles and the even numbered dial needles are caused to cast off the stitches on these needles from previous feeds. The odd numbered dial needles go through the normal welt motion for feed 8, retaining the stitches thereon from previous feeds.

Cylinder-needle stitches are formed by causing selected needles to take the yarn by some selecting means. These needles may be selected by any suitable mechanism, for example pattern wheels, jacquard drums, pattern disks, punched cards, perforated rolls, programmed tape, or electronic selection means, or they can be arranged in a two-track cam system such as arranging four needles in the top track and four needles in the bottom track or seven in the top track and seven in the bottom track. The wider the needle spacing between the stitches that knit and the stitches that miss at each course, the larger the holes will be in a horizontal direction. In the illustrated fabric, in the odd numbered feeds (1, 5 and 9) of the odd numbered courses there are knit stitches in cylinder wales C1, C2, C3, C4, C5, C13 and C14 and welt stitches in cylinder wales C6 through C12. In the odd numbered feeds (3, 7 and 11) of even numbered courses there are knit stitches in cylinder wales C1, C2, C3, C4, C5, C12, C13 and C14 and welt stitches in cylinder wales C6 through C11. In the even numbered feeds (2, 6 and 10) of odd numbered courses there are knit stitches in cylinder wales C6 through C12 and welt stitches in cylinder wales C1 through C5, C13 and C14. In the even numbered feeds (4 and 12) of even numbered courses, other than feed 8, there are knit stitches in cylinder wales C6 through C12 and welt stitches in cylinder wales C1 through C5, C13 and C14. Again there is no yarn for feed 8, and the cylinder needles for cylinder wales C6 through C12 are caused to cast off the stitches on these needles from previous feeds. The cylinder needles for cylinder wales C1 through C5, C13 and C14 go through the normal welt motion, retaining the stitches thereon from previous feeds.

On feed 8, the even numbered dial needles will be pushed out by the clearing cams so that the loops formed by the knit stitches in feed 7 with these needles will drop off the latches. When these needles are pulled back by the dial stitch cams, each loop falls off the end of the respective needle and drops to the previously formed stitch. The cylinder needle stitches on cylinder wales C6 through C12 will be cast off by the action of the selecting devices pushing these needles upwardly so that the previously formed knit stitches thereon fall off the latches. When these cylinder needles are pulled down by the cylinder stitch cams, each loop falls off the end of the respective needle and drops to the previously formed stitch. Normally the previously formed loop opens the latch when the needle goes to the clearing position, but after the casting off operation there are no loops on the needles that cast off their stitches at feed 8. Thus, suitable means are provided so that the latches closed during the casting off operation at feed 8 are then opened to allow the needles to receive the yarn at feed 10 for the cylinder needles and at feed 11 for the dial needles. These latches may be opened by a flat or a circular brush placed at an angle over the needleheads close to the clearing position of the needles so as the cylinder needles rise and the dial needles are pushed out, the bristles of the brush enter the latches and force them open. An alternate method of opening the latches can be made by placing a pointed curved needle in the track of the cylinder rotation at a point where the needles rise into the point which is aimed at the gap between the needle latches and the hook of the needles. Knitting is then resumed in the normal manner.

Figure 2:
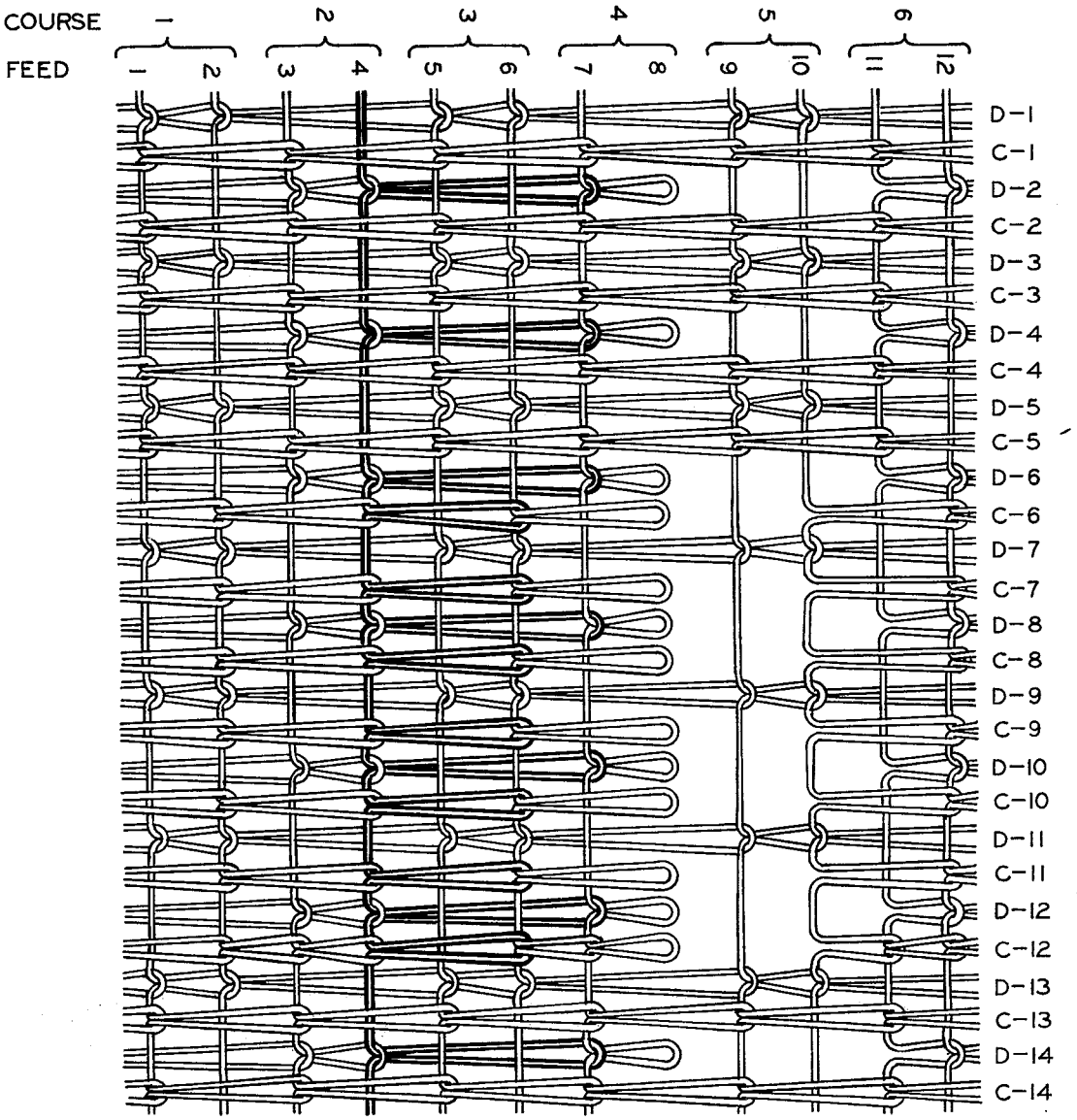
FIG. 2 is a schematic representation of a theoretical stitch construction of a double knit fabric corresponding to the pattern of FIG. 1 with the stitches being expanded laterally to show both the face stitches and the reverse side stitches.

The representation of the stitch construction in FIG. 2 illustrates the position of the yarns as knitted without regard to the effects of tension in the yarns. Due to the stress of normal tensions encountered in the knitting operation, each of the cast-off loops in wales D2, D4, D6, C6, C7, D8, C8, C9, D10, C10, C11, D12, C12 and D14 will retract a short distance toward the leading edge of the fabric. In some embodiments this degree of normal retraction may be sufficient to provide the desired openings in the fabric. In general, however, it will be necessary to subject the knitted fabric to additional stress to cause the cast-off stitches to unravel to the desired extent. The stressing of the fabric can be accomplished in any suitable manner; for example, the fabric can be subjected to an abrasive roller or stretched, particularly in the transverse direction. A locking yarn is employed to lock the cast-off stitches after the desired degree of retraction has been achieved. In the illustrated fabric the yarn at feed 4 is formed of a thermoplastic material having a lower melting temperature than the melting temperature of the body yarns at feeds 1 to 3 and 5 to 12. During the stressing of the knitted fabric, the cast-off stitches unravel to a point near but not past locking yarn 4. The thus stressed fabric is then heated to a temperature above the melting point of the locking yarns and below the melting point of the other yarns to cause the locking yarn to melt and fuse to the contiguous portions of the other yarns. The heating can be accomplished by any suitable means, for example a hot air oven, heated rollers, or infrared radiation. Upon cooling of the thus heated fabric to a temperature below the melting point of the locking yarns, each locking yarn is thermally bonded to the touching portions of the other yarns, thereby preventing the cast-off stitches from unraveling through the locking yarns. The yarn that melts at the lower temperature forms a welded surface on the yarns that melt at a higher temperature and prevents the interstices of the loops pulling through one another.

The locking yarns and the body yarns can be made of any suitable materials so long as the melting temperature of the locking yarns is below the melting temperature of the body yarns. While both the locking yarn and the body yarns have been illustrated as unbulked monofilaments in FIG. 2 for sake of simplicity, it is within the scope of the invention to employ either bulked or unbulked yarns, of either monofilament or multifilament, with the multifilaments being continuous filaments or staple or a blend of continuous filaments and staple. The body yarns can be either natural or synthetic material or a combination thereof, while the locking yarns are of synthetic organic thermoplastic material. Synthetic yarns which can be employed include linear condensation polymers or linear addition polymers, for example, acrylonitrile polymers and copolymers; polyamides, such as polyhexamethylene adipamide, polycaproamide, poly(meta-phenylene isophthalamide), and copolyamides; polyesters, such as polypivalolactone, polyethylene terephthalate, and copolyesters prepared from glycols and terephthalic and isophthalic acids; polyolefins, such as homopolymers of ethylene, ethylene copolymers, homopolymers of propylene, and propylene copolymers; polybeazimidazole; copolymers of acrylonitrile with small amount of copolymerizable monomers such as methyl methacrylate or polymerizable monomers such as methyl methacrylate or vinyl acetate; and the like. Specific examples of suitable body yarns include 150 denier 34 filament textured polyester yarns, 22/1 cotton count spun polyester yarns, 22/1 cotton count spun acrylic yarns, and 22/1 cotton yarns. While the locking yarns can be textured or untextured continuous filament yarn, the spun yarns are generally preferred because the hairy nature of the spun yarns results in better locking performance. Textured continuous filament polypropylene yarns having a denier in the range of 70 to 150 are advantageous in many applications. In the presently preferred embodiment the locking yarns are spun polypropylene yarns having a cotton count in the range of about 18/1 to about 30/1.

Figure 3:
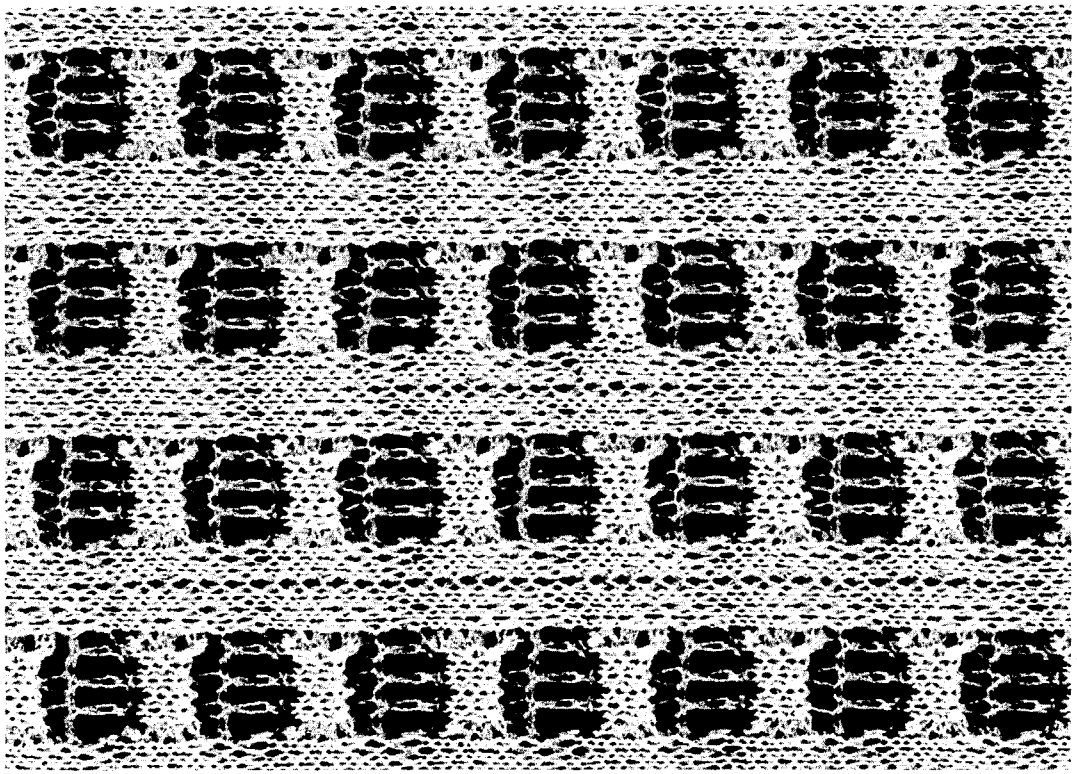
FIG. 3 is a photographic reproduction of the face side of a double knit textile fabric made with the repeat pattern of FIG. 1.

In the fabric illustrated in FIG. 3 the locking yarns are 20/1 cotton count yarns spun from 3 denier per filament polypropylene staple fibers having a melting temperature of about 160° C. while the body yarns are 150 denier 34 filament textured yarns made of polyester having a melting temperature of 250° C. The fabric was knitted on an 18-cut Bentley 8RJ machine having 18 needles per inch in the cylinder and 18 needles per inch in the dial. The tubular fabric was slit and then scoured at about 71° C. for 30 minutes in an aqueous bath containing 1 weight percent, based on the fabric, Scour-Rite TE (Wright Chemical Company) and 1 weight percent, based on the fabric, tetrasodium pyrophosphate. The scoured fabric was rinsed in cold water and then tumbled to remove excess water. The thus treated fabric, which had a relaxed width of less than about 56 inches was then tenter framed with 62-inch pin settings and 10 percent overfeed. The tenter frame was passed through a hot air oven at 12 yards/minute so that the fabric was heated to just above the melting temperature of the polypropylene yarns.

Many variations of this fabric can be made on multifeed and jacquard machines. It is possible to form other jacquard designs between the press-off feeds. It is also possible to form stitches on the dial needles only by stopping the cylinder needles knitting to stabilize the fabric and further aid in preventing the stitches pulling out. The two-course sequence illustrated in FIGS. 1 and 2 can be repeated for as many courses as desired although the limit will be 11 on a 24 feed machine, 17 on a 36 feed machine, 21 on a 44 feed machine, 23 on a 48 feed machine, etc., the remaining course including the cast-off operation feed. The more feeds on the knitting machine, the longer the spacing of the holes in a vertical direction can be. Spacings can be made closer together by decreasing the number of feeds between the press-off feeds where no yarn is fed. In the fabric illustrated, there are six courses (made by 12 feeds) in a repeat pattern. This identical fabric can, therefore, be produced on a 24 feed machine, as a 48 feed machine, or 96 feed machine.

In any of the patterns it will generally be advantageous to have longer stitch length for the loops being cast off than average for the fabric, as the long stitches provide greater resistance to premature unraveling. It is also advantageous to have longer stitch lengths for the knit stitches in the locking yarns corresponding to the cast-off loops than average for the fabric to provide more yarn in each stitch and thus more locking surface.

While the invention has been illustrated in terms of a double knit fabric, it is also applicable to the formation of openings in a single knit fabric, for example a jersey fabric. Similarly while the illustrated fabric has two yarns in each course, fabrics embodying the invention can be knitted with only one feed yarn per course or with three or more yarns per course. As the reference point for the repeat pattern is arbitrary, the use of the designations "odd" and "even" for wales, feeds and courses are for the sake of simplicity, it being recognized that the identical repeat pattern can be defined starting with a different feed and a different wale. Other reasonable variations and modifications are possible within the scope of the foregoing disclosure, the drawings and the appended claims to the invention.

That which is claimed is:

1. A method of preparing a double knit fabric having a plurality of relatively open areas, which comprises:

(I) forming a double knit fabric by (a) knitting at least one body course employing at least one first yarn;

(b) then knitting, in immediate succession to said at least one body course, at least one first locking course employing at least one second yarn, said second yarn being formed of a thermoplastic material having a lower melting point than said first yarn; and (c) then in immediate succession to said at least one first locking course, knitting a first plurality of consecutive body courses employing a plurality of first yarns while causing, in each of a plurality of areas in said first plurality of consecutive body courses, at least one stitch to be cast off;

(II) stressing the thus knitted fabric to cause the thus cast-off stitches to unravel to a point near to but not past said at least one first locking course employing at least one second yarn;

(III) heating the thus stressed fabric to a temperature above the melting point of said at least one second yarn and below the melting point of said first yarns to cause said at least one second yarn to fuse to the first yarns touching said at least one second yarn; and (IV) cooling the thus heated fabric to a temperature below the melting point of said at least one second yarn to thereby prevent the cast-off stitches from unraveling through said at least one first locking course employing at least one second yarn.

2. A method in accordance with claim 1 wherein the step of forming said fabric further comprises (d) knitting, in immediate succession to said first plurality of consecutive body courses, at least one second locking course employing at least one second yarn of said thermoplastic material; and (e) then knitting in immediate succession to said at least one second locking course, a second plurality of consecutive body courses employing a plurality of first yarns while causing, in each of a plurality of areas in said second plurality of consecutive body courses, at least one stitch to be cast off; and wherein the step of stressing the thus knitted fabric causes the respective cast-off stitches to unravel to a point near to but not past the at least one second yarn of the next preceding locking course.

3. A method in accordance with claim 2 wherein said thermoplastic material is a polymer of propylene.

4. A method in accordance with claim 3 wherein each of said first yarns is a nylon yarn.

5. A method in accordance with claim 3 wherein each of said first yarn is a polyester yarn.

6. A method in accordance with claim 1 wherein the cast-off stitches are made by selected cylinder needles and by selected dial needles.

7. A method in accordance with claim 6 wherein said selected cylinder needles and said selected dial needles are inactivated for several courses immediately following the production of the respective cast-off stitches to thereby produce segments of single knit fabric and are then reactivated to resume production of double knit fabric.

8. A method in accordance with claim 7 wherein said cast-off stitches occur at predetermined intervals.

9. A method in accordance with claim 8 wherein said cast-off stitches have a longer stitch length than the average stitch length for the fabric.

10. A method in accordance with claim 9 wherein the knit stitches in said second yarns corresponding to the respective cast-off stitches have a longer length than the average stitch length for the fabric.

11. A method in accordance with claim 1 wherein each said second yarn is a spun yarn.

12. A method in accordance with claim 1 wherein each said second yarn is a textured yarn.

13. A double knit fabric having a plurality of relatively open areas, which comprises at least one body course containing at least one first yarn;

in immediate succession to said at least one body course, at least one first locking course containing at least one second yarn, each said second yarn being formed of a thermoplastic material having a lower melting point than said first yarn; and in immediate succession to said at least one first locking course, a first plurality of consecutive body courses containing a plurality of first yarns, in each of a plurality of areas in said first plurality of consecutive body courses at least one stitch having been cast off and unraveled toward but not past said at least one first locking course;

said at least one second yarn being fused to the touching first yarns to prevent said cast-off stitches from unraveling past said at least one second yarn.

14. A fabric in accordance with claim 13 further comprising in immediate succession to said first plurality of consecutive body courses, at least one second locking course containing at least one second yarn of said thermoplastic material; and in immediate succession to said at least one second locking course, a second plurality of consecutive body courses containing a plurality of first yarns, in each of a plurality of areas in said second plurality of consecutive body courses at least one stitch having been cast off and unraveled toward but not past said at least one second locking course;

said at least one second yarn of said at least one second locking course being fused to the touching first yarns to prevent said cast-off stitches of said second plurality of consecutive body courses from unraveling past said at least one second yarn of said at least one second locking course.

15. A fabric in accordance with claim 14 wherein said thermoplastic material is a polymer of propylene.

16. A fabric in accordance with claim 15 wherein each of said first yarns is a nylon yarn.

17. A fabric in accordance with claim 15 wherein each of said first yarns is a polyester yarn.

18. A fabric in accordance with claim 13 wherein each said second yarn is a spun yarn.

19. A fabric in accordance with claim 13 wherein each said second yarn is a textured yarn.

20. A fabric in accordance with claim 13 wherein said cast-off stitches have a longer stitch length than the average stitch length for the fabric.

21. A fabric in accordance with claim 20 wherein the stitches in said second yarns corresponding to the respective cast-off stitches have a longer length than the average stitch length for the fabric.

22. A fabric in accordance with claim 21 wherein each of said first yarns is a polyester yarn and each of said second yarns is a polypropylene yarn.

23. A method in accordance with claim 2 wherein said second yarn is a single yarn.

* * * * *